US009974707B1

(12) United States Patent
Donahoe et al.

(10) Patent No.: US 9,974,707 B1
(45) Date of Patent: May 22, 2018

(54) COMBINATION WALKER AND CANE

(71) Applicants: Dustin T Donahoe, Grapevine, TX (US); Ashley Donahoe, Grapevine, TX (US)

(72) Inventors: Dustin T Donahoe, Grapevine, TX (US); Ashley Donahoe, Grapevine, TX (US)

( * ) Notice: Subject to any disclaimer, the term of this patent is extended or adjusted under 35 U.S.C. 154(b) by 0 days. days.

(21) Appl. No.: 15/132,324

(22) Filed: Apr. 19, 2016

Related U.S. Application Data

(60) Provisional application No. 62/152,159, filed on Apr. 24, 2015.

(51) Int. Cl.
*A61H 3/00* (2006.01)
*A45B 9/02* (2006.01)
*A45B 3/00* (2006.01)

(52) U.S. Cl.
CPC ..... *A61H 3/00* (2013.01); *A45B 3/00* (2013.01); *A45B 9/02* (2013.01)

(58) Field of Classification Search
CPC .... A45B 9/00; A45B 9/02; A45B 3/00; A45B 1/02; A61H 3/00; A61H 3/04; A61H 3/02; A61H 2003/025
USPC ..... 135/65–67, 68, 76, 85; 482/65–69, 75
See application file for complete search history.

(56) References Cited

U.S. PATENT DOCUMENTS 4,993,446 A * 2/1991 Yarbrough ..... A61H 3/00 135/67
4,995,412 A * 2/1991 Hirn ..... A61H 3/00 135/67
5,477,211 A * 12/1995 Reynolds ..... A61G 5/10 135/65
5,785,070 A * 7/1998 Block ..... A45B 9/00 135/65
6,913,279 B1 * 7/2005 Opalka ..... A61H 3/00 135/65
6,966,470 B1 * 11/2005 Charlton ..... A45C 13/26 135/66
6,990,990 B2 * 1/2006 Wilensky ..... A61H 3/00 135/67
7,021,324 B1 * 4/2006 Clay ..... A61H 3/04 135/66
7,373,942 B1 * 5/2008 Yeager ..... A61H 3/00 135/67
8,291,924 B2 * 10/2012 King ..... A45B 7/00 135/65
9,186,289 B2 * 11/2015 Nicholas ..... A61G 5/10
2010/0051076 A1 * 3/2010 McGann ..... A61H 3/00 135/67
2011/0226296 A1 * 9/2011 Huggins ..... A45B 1/00 135/66

* cited by examiner

*Primary Examiner* — Winnie Yip
(74) *Attorney, Agent, or Firm* — Kenneth L. Tolar

(57) ABSTRACT

A combination walker and cane includes a pair of inverted, U-shaped frame members, each having a horizontal handlebar with a front leg and a rear leg depending therefrom. One of the rear legs is detachable from the remainder of the corresponding frame member to form a walking cane, if desired. Accordingly, a user can operate the walker in a conventional fashion, or detach the rear leg to form a walking cane.

5 Claims, 2 Drawing Sheets

COMBINATION WALKER AND CANE

CROSS REFERENCE TO RELATED APPLICATIONS

This application is entitled to the benefit of provisional patent application No. 62/152,159 filed on Apr. 24, 2015, the specification of which is incorporated herein by reference.

BACKGROUND OF THE INVENTION

The present invention relates to a walker having a leg that is detachable to form a cane when needed to ambulate in confined areas.

DESCRIPTION OF THE PRIOR ART

Those who ambulate with a walker must also transport a cane in order to move within confined spaces or to use stairways. However, holding a cane while operating a walker is cumbersome and inconvenient, particularly for the physically impaired. Though the cane may be horizontally supported on the walker's handlebars, it easily snags nearby objects, often causing accidents or property damage.

Accordingly, there is currently a need for a means of more easily transporting a cane when using a walker. The present invention addresses this need by providing a walker having a leg that can be detached to form a walking cane.

SUMMARY OF THE INVENTION

The present invention relates to a combination walker and cane comprising a pair of inverted, U-shaped frame members, each having a horizontal handlebar with a front leg and a rear leg depending therefrom. One of the rear legs is detachable from the remainder of the corresponding frame member to form an L-shaped walking cane, if desired. Accordingly, a user can operate the walker in a conventional fashion, or detach the rear leg to form a walking cane.

It is therefore an object of the present invention to provide a device that eliminates the need to separately transport a cane when using a walker.

It is therefore another object of the present invention to provide a walker having a rear leg that is detachable to form a cane.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
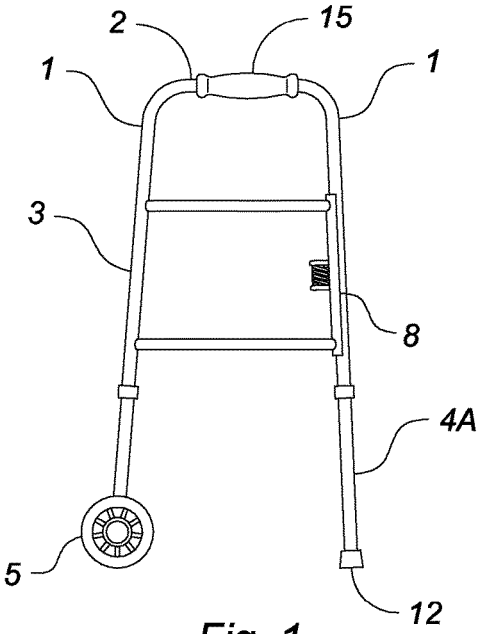
FIG. 1 is a side view of the combination walker and cane according to the present invention.
Figure 2:
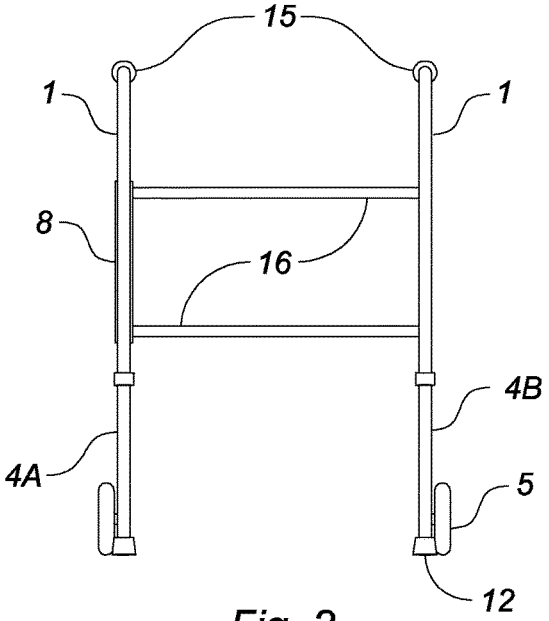
FIG. 2 is a rear view of the device.
Figure 3:
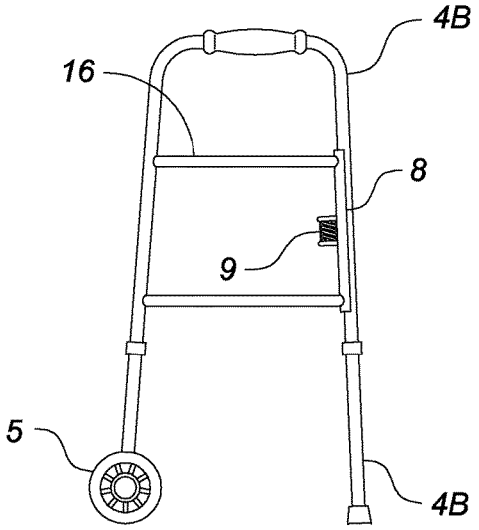
FIG. 3 depicts the device of FIG. 1 with the rear leg detached.
Figure 4:
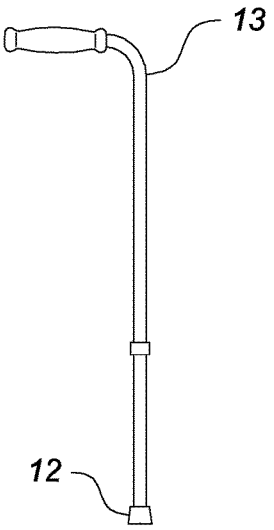
FIG. 4 is an isolated view of the removable leg/cane.
Figure 5:
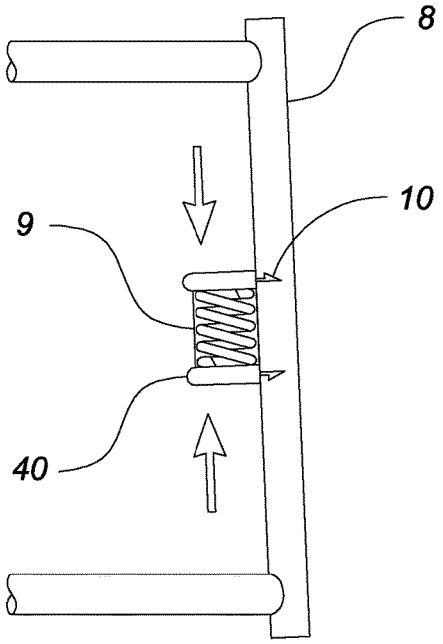
FIG. 5 is an isolated view of the brace member and spring-biased latch mechanism.
Figure 6:
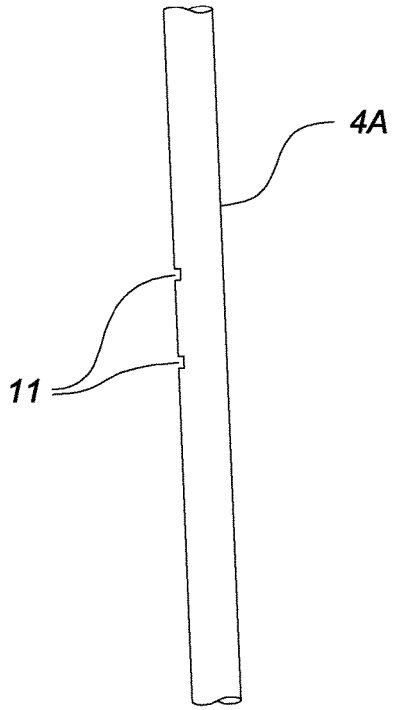
FIG. 6 is an isolated view of the rear leg of FIG. 5 removed from the brace member.
Figure 7:
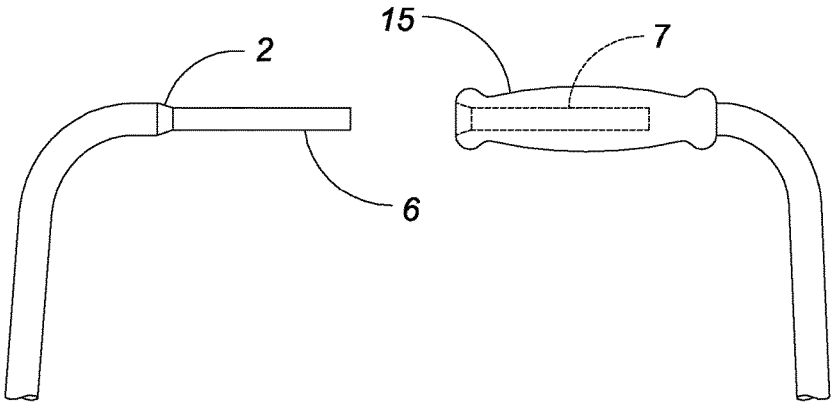
FIG. 7 is an isolated view of the detachable handgrip and mating tubular insert.

The present invention relates to a combination walker and cane comprising a pair of inverted, U-shaped frame members 1, each having a horizontal handlebar 2 with a front leg 3 and a rear leg 4A, 4B depending therefrom. At the lower, distal end of each front leg is a caster or wheel 5 that allows the frame members to roll along an underlying surface. A distal end of each rear leg includes a footpad 12 for gripping an underlying surface. Each handlebar includes a foam handgrip 15 that a user grasps when using the device as a walker. Support struts 16 interconnect the two front legs, and each front leg and rear leg, to allow the frame members to adequately support a user's body weight.

One of the rear legs 4A is detachable from the remainder of the corresponding frame member to form a walking cane, if desired. The handlebar 2 of the corresponding frame member is formed of a tubular insert 6 that removably seats within an axial bore 7 in the handgrip 15 interior. The support struts that extend between the front leg and the detachable rear leg terminate at a horizontal, semi-cylindrical brace member 8. Mounted on the brace member is a collapsible, protective casing 40 having coiled spring 9 received therein. The casing 40 includes end caps connected to one of a pair of barbed latches 10 that releasably secure the detachable leg to the corresponding frame member. When the casing is compressed, the latches disengage from designated openings 11 on the detachable leg 4A.

Accordingly, when traversing open spaces, a user operates the walker in a conventional fashion. If a cane is needed to ambulate within confined spaces, the user compresses the spring casing to release the detachable leg. The handgrip is then separated from the handlebar insert 6 to form an L-shaped walking cane 13 that may be used as desired.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination walker and cane comprising:

a first inverted, U-shaped frame member and a second inverted, U-shaped frame member, said first inverted, U-shaped frame member and said second inverted U-shaped frame member each formed of a horizontal handlebar with a front leg and a rear leg depending therefrom;

a pair of support struts extending from the front leg of said first U-shaped frame member;

a brace member at distal ends of said support struts, said brace member engaging the rear leg of said first U-shaped frame member;

a compressible spring mounted on said brace member;

a pair of barbed latches connected to said spring that releasably seat within openings on the rear leg of said first U-shaped frame member whereby when said spring is compressed, the latches disengage from said openings to release said rear leg from said brace member to form a walking cane.

2. The combination according to claim 1 wherein the horizontal handlebar of said first U-shaped frame member comprises:

a horizontal handgrip at an upper end of the rear leg of said first U-shaped frame member, said handgrip having an axial bore;

a horizontal tubular insert at an upper end of the front leg of said first U-shaped frame member, said insert removably seating within said axial bore.

3. The combination according to claim 1 further comprising a caster at a lower end of the front leg of said first inverted, U-shaped frame member and at the lower end of the second inverted, U-shaped frame member that allows the first inverted, U-shaped frame member and the second inverted, U-shaped frame member frame to roll along an underlying surface.

4. The combination according to claim 1 wherein the handlebar on said second inverted U-shaped frame member includes a foam handgrip that a user grasps when the combination is used as a walker.

5. The combination according to claim 1 wherein a distal end of the rear leg of each of said first inverted, U-shaped frame member and the second inverted, U-shaped frame member includes a footpad for gripping an underlying surface.

* * * * *